US009915105B2

(12) United States Patent
Barannikow et al.

(10) Patent No.: US 9,915,105 B2
(45) Date of Patent: Mar. 13, 2018

(54) SWIVEL AND METHOD OF USE

(71) Applicant: Weatherford Technology Holdings, LLC, Houston, TX (US)

(72) Inventors: Ivan Andre Barannikow, Houma, LA (US); Douglas Brian Farley, Missouri City, TX (US); Egor Dudochkin, Conroe, TX (US); Steven Michael Rosenberg, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 218 days.

(21) Appl. No.: 14/709,953

(22) Filed: May 12, 2015

(65) Prior Publication Data

US 2015/0330156 A1 Nov. 19, 2015

Related U.S. Application Data

(60) Provisional application No. 61/994,629, filed on May 16, 2014.

(51) Int. Cl.

| | |
|---|---|
| ***E21B 17/05*** | (2006.01) |
| ***E21B 21/02*** | (2006.01) |
| ***E21B 33/13*** | (2006.01) |
| ***E21B 17/046*** | (2006.01) |
| ***E21B 17/02*** | (2006.01) |

(52) U.S. Cl.

CPC ..... *E21B 17/05* (2013.01); *E21B 17/021* (2013.01); *E21B 17/046* (2013.01); *E21B 21/02* (2013.01); *E21B 33/13* (2013.01)

(58) Field of Classification Search

CPC ..... E21B 17/05; E21B 21/02; E21B 33/13; E21B 17/021; E21B 17/06; E21B 17/073

See application file for complete search history.

(56) References Cited

U.S. PATENT DOCUMENTS

| | | | |
|---|---|---|---|
| 3,528,686 | A | 9/1970 | Nelson |
| 4,105,069 | A | 8/1978 | Baker |
| 4,286,658 | A | 9/1981 | Baker et al. |
| 4,333,530 | A | 6/1982 | Armstrong |
| 4,751,967 | A | 6/1988 | Blandford et al. |
| 4,848,459 | A | 7/1989 | Blackwell et al. |

(Continued)

FOREIGN PATENT DOCUMENTS

WO 2013/103785 A2 7/2013

OTHER PUBLICATIONS

UK Search Report dated Mar. 23, 2016, for UK Patent Application No. GB1508335.5.

(Continued)

*Primary Examiner* — Cathleen R Hutchins

(74) *Attorney, Agent, or Firm* — Patterson & Sheridan, L.L.P.

(57) ABSTRACT

A swivel configured to rotationally decouple an upper section of a work string from a lower section of the work string. The swivel includes an upper body coupled to a lower body by a ring member and a plurality of shearable members. The lower body has a plurality of teeth members that engage a plurality of teeth members of the ring member. Rotation of the upper body is transmitted to the lower body by the ring member. The upper body is rotatable relative to the lower body when the shearable members are sheared.

8 Claims, 12 Drawing Sheets

(56) References Cited

U.S. PATENT DOCUMENTS

| | | | | |
|---|---|---|---|---|
| 4,869,323 | A | 9/1989 | Stagg | |
| 5,443,124 | A | 8/1995 | Wood et al. | |
| 2004/0094309 | A1* | 5/2004 | Maguire | E21B 17/05 166/381 |
| 2004/0144567 | A1 | 7/2004 | Boyd | |
| 2004/0144571 | A1* | 7/2004 | Boyd | E21B 17/05 175/321 |
| 2010/0051276 | A1 | 3/2010 | Rogers et al. | |
| 2013/0161101 | A1 | 6/2013 | Zhou | |

OTHER PUBLICATIONS

UK Examination Report dated Mar. 23, 2016, for UK Patent Application No. GB1508335.5.
Canadian Office Action dated Apr. 22, 2016, for Canadian Patent Application No. 2,891,579.
Canadian Office Action dated Jul. 7, 2016, for Canadian Patent Application No. 2,891,570.
UK Combined Search and Examination Report dated Jul. 29, 2015, for Application No. GB1508336.3.
United Kingdom Examination Report dated May 11, 2017, for Patent Application No. GB1508336.3.
United Kingdom Examination Report dated Apr. 11, 2017, for Application No. GB1508335.5.
Canadian Office Action dated Jul. 5, 2017, corresponding to Application No. 2,891,570.

* cited by examiner

| DIMENSIONS | | | | |
|---|---|---|---|---|
| MAXIMUM OD | 301.63 | mm | 11.875 | in |
| MINIMUM ID | 216.54 | mm | 8.525 | in |
| RATINGS | | | | |
| MATERIALS | API C-110 | | | |
| MINIMUM YIELD STRENGTH | 758.4 | MPa | 110000 | PSI |
| BURST | 75.2 | MPa | 10900 | PSI |
| COLLAPSE | 54.8 | MPa | 7950 | PSI |
| TENSION | 7606 | kN | 1710 | KIP |
| TORQUE | 33890 | N.m | 25000 | FT-LB |

| DIMENSIONS | | | | |
|---|---|---|---|---|
| MAXIMUM OD | 208.3 | mm | 8.200 | in |
| MINIMUM ID | 156.1 | mm | 6.145 | in |
| RATINGS | | | | |
| MATERIALS | API Q-125 | | | |
| MINIMUM YIELD STRENGTH | 862 | MPa | 125000 | PSI |
| BURST | 87.9 | MPa | 12750 | PSI |
| COLLAPSE | 62.7 | MPa | 9100 | PSI |
| TENSION | 3358 | kN | 755 | KIP |
| TORQUE | 20330 | N.m | 15000 | FT-LB |

SWIVEL AND METHOD OF USE

CROSS REFERENCE TO RELATED APPLICATIONS

This application claims benefit of U.S. Provisional Patent Application Ser. No. 61/994,629, filed May 16, 2014, the contents of which are incorporated herein by reference in their entirety.

BACKGROUND OF THE INVENTION

Field of the Invention

Embodiments of the invention generally relate to a swivel configured to rotationally decouple an upper section of a work string from a lower section of the work string while the work string is positioned in a wellbore.

Description of the Related Art

A wellbore is formed by rotating and lowering a work string, which has a drill bit connected at the lower end, into the earth. Fluid is circulated into the wellbore while the wellbore is being formed to remove the drilled earth and other wellbore debris. In particular, fluid is supplied down into the wellbore through an inner bore of the work string. The fluid will flow back up to the surface through the annulus formed between the outer surface of the work string and the inner surface of the wellbore, carrying out the drilled earth and other wellbore debris.

The wellbore is drilled until it reaches a reservoir within the earth. Sometimes, when the reservoir is reached, the fluid circulated into the wellbore flows into the reservoir, which hinders fluid circulation back to the surface and removal of the drilled earth and other wellbore debris. The drilled earth and other wellbore debris that are not removed will begin to accumulate at the bottom of the wellbore, as well as within the annulus formed between the outer surface of the work string and the inner surface of the wellbore. The accumulation of the drilled earth and other wellbore debris clogs the wellbore and prevents the lower end of the work string from rotating. Continued rotation of the work string from the upper end while the lower end is prevented from rotating causes the work string to twist, which can damage any connections or other tools that are part of and/or located between the lower end and the upper end of the work string.

When the reservoir is reached, the work string is prepared to be cemented in the wellbore. A packing element disposed on the work string at a location above the reservoir is actuated (such as by hydraulic pressure) into engagement with the wellbore to sealingly isolate the reservoir from the section of the annulus above the reservoir. A port disposed on the work string above the packing element is opened (such as by hydraulic pressure), and cement is circulated down through the inner bore of the work string, out into the wellbore through the port, and back up to the surface through the annulus formed between the outer surface of the work string and the inner surface of the wellbore. The packing element prevents the cement from flowing down into the reservoir.

It is desirable to rotate the work string while circulating the cement to help uniformly distribute the cement along the annulus. However, the work string is secured in the wellbore by the packing element. Rotation of the packing element while in sealed engagement with the wellbore can tear or otherwise damage the packing element. Additionally, even if the work string could rotate with or relative to the packing element, the lower end of the work string is still prevented from rotation due to the accumulation of the drilled earth and other wellbore debris as discussed above.

Therefore, there is a need for a new and/or improved methods and/or apparatus configured to selectively allow rotation of an upper section of a work string relative to a lower section of the work string.

SUMMARY OF THE INVENTION

In one embodiment, a swivel comprises an upper body; a ring member coupled to the upper body by a plurality of shearable members; and a lower body having a plurality of teeth members engaged with a plurality of teeth members of the ring member, wherein rotation of the upper body is transmitted to the lower body by the ring member, and wherein the upper body is rotatable relative to the lower body when the shearable members are sheared.

In one embodiment, a method of using a work string having a swivel within a wellbore comprises rotating the work sting within the wellbore, wherein rotation of an upper section of the work string is transmitted to a lower section of the work string by the swivel; actuating a packing element of the work string into engagement with the wellbore, wherein the packing element is disposed below the swivel; and actuating the swivel to rotationally decouple the upper section of the work string from the lower section of the work string.

BRIEF DESCRIPTION OF THE DRAWINGS

So that the manner in which the above recited features can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
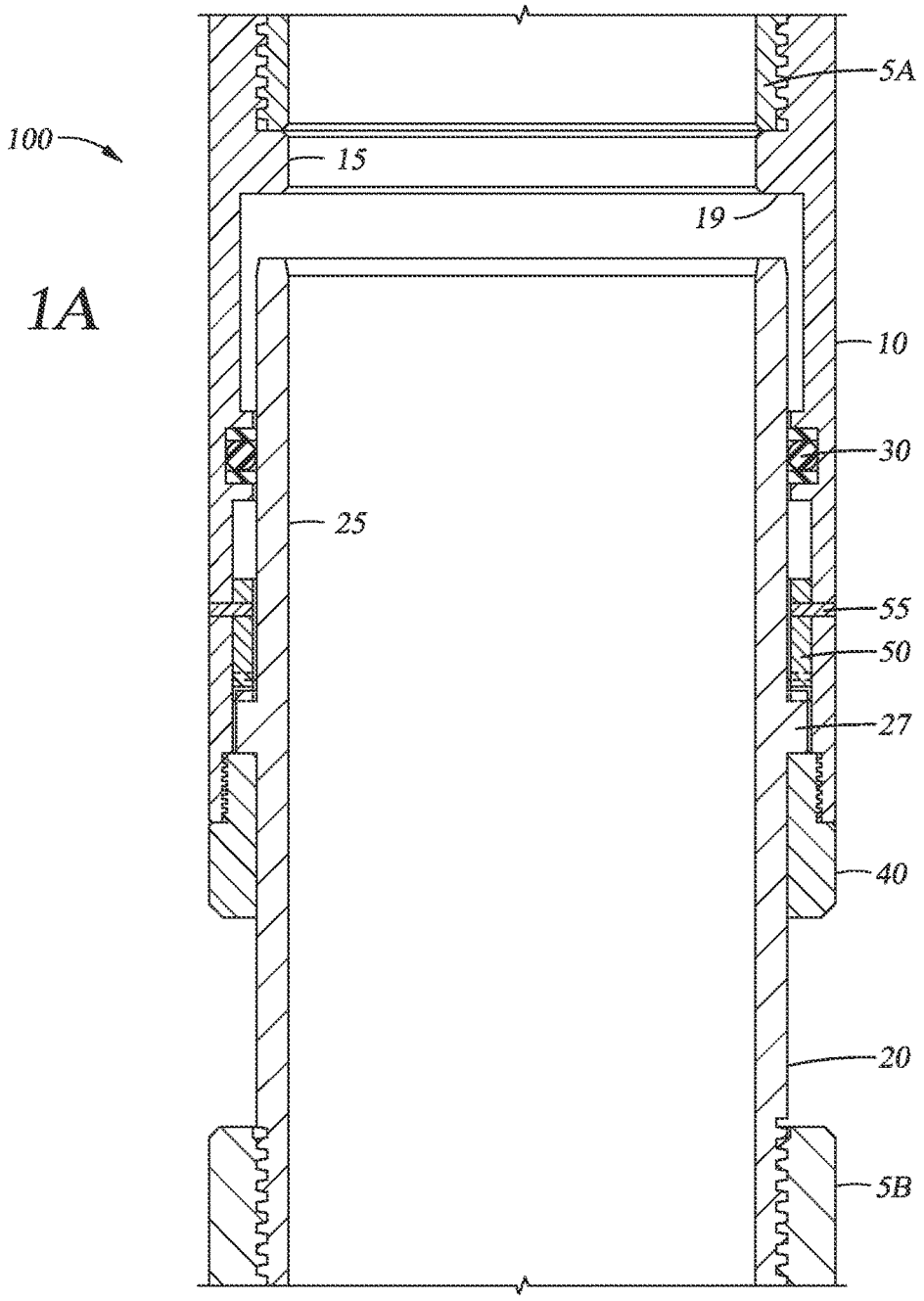
FIG. 1A is a cross-sectional view of a swivel in a first operating position according to one embodiment.

FIG. 1A is a cross-sectional view of a swivel 100 in a first operating position. In the first operating position, the swivel 100 is configured to transmit rotation of an upper section 5A of a work string to a lower section 5B of the work string. When actuated, the swivel 100 is configured to rotationally decouple the upper and lower sections 5A, 5B to allow the upper section 5A of the work string to rotate relative to the lower section 5B of the work string. The upper and/or lower sections 5A, 5B of the work string can include one or more tubular members, such as casing, liner, and/or drill pipe, which are coupled together.

The swivel 100 includes an upper body 10 and a lower body 20. The upper body 10 includes a tubular member having an inner bore 15 formed through the upper body 10. An upper end of the upper body 10 is coupled to the upper section 5A of the work string, such as by a threaded and/or welded connection. The lower body 20 includes a tubular member having an inner bore 25 formed through the lower body 20, which is in fluid communication with the inner bore 15 of the upper body 10. A lower end of the lower body 20 is coupled to the lower section 5B of the work string, such as by a threaded and/or welded connection.

One or more seals/bearings 30 are disposed between the inner surface of the upper body 10 and the outer surface of the lower body 20. The seals/bearings 30 form a sealed engagement between upper body 10 and the lower body 20. The seals/bearings 30 minimize friction between the upper body 10 and the lower body 20 when the upper body 10 rotates relative to the lower body 20. One or more debris protection members can be used to prevent interference with the seal/bearing areas.

A load bearing member 40 is coupled to a lower end of the upper body 10 by a threaded connection, although other types of connections can be used. The load bearing member 40 supports the weight of the lower body 20 and the lower section 5B of the work string as the work string is lowered into a wellbore. In particular, an outer shoulder 27 of the lower body 20 engages an upper surface of the load bearing member 40. Optionally, a bearing member, such as a journal bearing, a roller bearing, and/or a xylene coating, can be positioned between the lower surface of the outer shoulder 27 and the upper surface of the load bearing member 40 to minimize friction between these surfaces when in contact and when the upper body 10 is rotated relative to the lower body 20. A similar bearing member can be positioned between the lower surface of an inner shoulder 19 of the upper body 10 and the upper end of the lower body 20 to minimize friction between these surfaces when in contact (as illustrated in FIG. 1C) and when the upper body 10 is rotated relative to the lower body 20.

Rotation of the upper body 10 is transmitted to the lower body 20 through a ring member 50 and a plurality of shearable members 55 of the swivel 100. The shearable members 55 are disposed through the upper body 10 and the ring member 50. Rotation of the upper body 10 is transmitted to the ring member 50 by the shearable members 55.

Figure 1B:
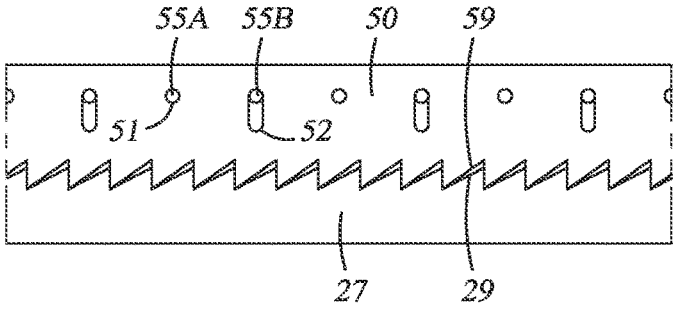
FIG. 1B is an enlarged view of an outer section of a ring member in contact with a shoulder of a lower body of the swivel in the first operating position according to one embodiment.
Figure 1C:
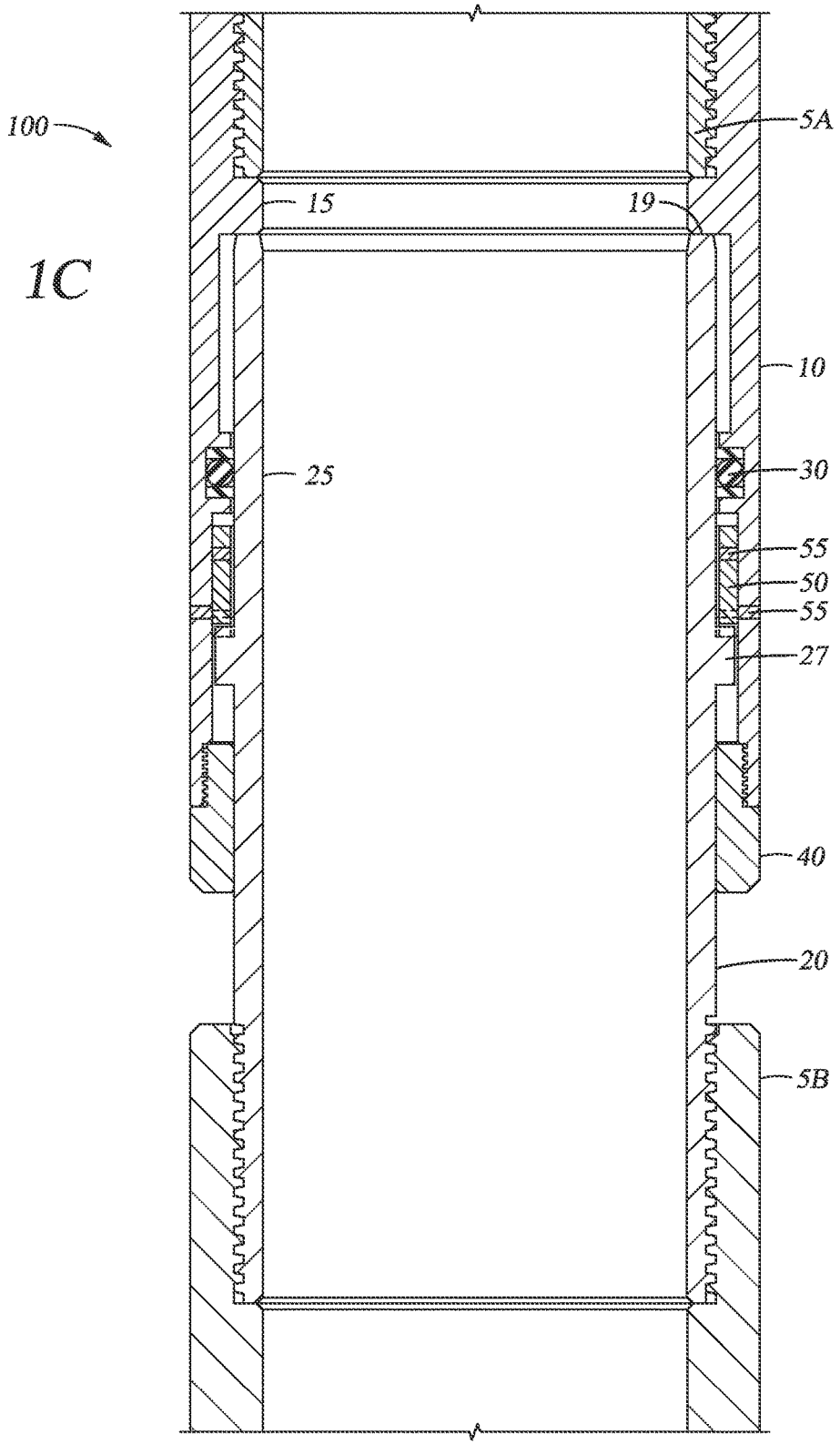
FIG. 1C is a cross-sectional view of the swivel in a second operating position according to one embodiment.

FIG. 1B illustrates a portion of the outer surfaces of the ring member 50 and the outer shoulder 27 of the lower body 20 in contact with each other. As illustrated in FIG. 1B, a lower end of the ring member 50 includes a plurality of teeth members 59 having a saw tooth profile. The teeth members 59 engage a plurality of corresponding teeth members 29 also having a saw tooth profile formed on an upper surface of the outer shoulder 27 of the lower body 20. Rotation transmitted to the ring member 50 by the upper body 10 via the shearable members 55 is transmitted to the lower body 10 by the engagement of the teeth members 29, 59.

When the swivel 100 is in the first operating position as shown in FIG. 1A, the upper section 5A of the work string, the swivel 100, and the lower section 5B of the work string rotate together as a single unit. The upper and lower sections 5A, 5B of the work string and any other tools coupled to the upper and lower sections 5A, 5B, including the swivel 100, can be rotated to form a wellbore and/or while being lowered into an existing wellbore. When desired, the swivel 100 can be actuated to rotationally decouple the upper section 5A of the work string from the lower section 5B of the work string as shown in FIG. 1C.

FIG. 1C is a cross-sectional view of the swivel 100 in a second operating position. In the second operating position, the swivel 100 rotationally decouples the upper and lower sections 5A, 5B to allow the upper section 5A of the work string to rotate relative to the lower section 5B of the work string. To actuate the swivel 100 to the second operating position, a mechanical, compressive force is applied to the upper body 10, which applies a shear force to the shearable members 55 to shear the shearable members 55. The work string can be set down on the bottom of the wellbore so that a compressive force can be applied to the upper body 10 to shear the shearable members 55. Additionally or alternatively, a sealing/anchoring member may be used to secure the lower section 5B of the work string in the wellbore so that a compressive force can be applied to the upper body 10 to shear the shearable members 55.

As illustrated in FIG. 1C, when the shearable members 55 are sheared, the upper body 10 can be lowered relative to the lower body 20 until an inner shoulder 19 of the upper body 10 contacts the upper end of the lower body 20. When the shearable members 55 are sheared, rotation of the upper body 10 can no longer be transmitted to the ring member 50, and thus to the lower body 20, through the shearable members 55. Rather, the upper body 10 can be rotated relative to both the ring member 50 and the lower body 20. The upper section 5A of the work string can be rotated relative to the lower section 5B of the work string when the swivel 100 is actuated to the second operating position.

Referring back to FIG. 1B, a first plurality of the shearable members 55A extend into one or more openings 51 formed in the ring member 50, and a second plurality of the shearable members 55B extend into one or more longitudinal slots 52 formed in the ring member 50. The openings 51 and the slots 52 allow the shearable members 55A, 55B to be sheared in a staged sequence. Specifically, the compressive force applied to the upper body 10 will apply a first shear force to the first plurality of the shearable members 55A that extend into the openings 51. Since the second plurality of shearable members 55B are positioned at the upper end of the slots 52, the first shear force is not transmitted to the second plurality of shearable members 55B.

When the first plurality of shearable members 55A are sheared, the second plurality of shearable members 55B are moved downward to the opposite ends of the slots 52 as the upper body 10 is lowered relative to the ring member 50. The second plurality of shearable members 55B will engage the ends of the slots 52, and the compressive force applied to the upper body 10 will apply a second shear force to shear the second plurality of shearable members 55B. When the shearable members 55A, 55B extending into the openings 51 and the slots 52 are sheared, the upper body 10 is rotationally decoupled from the lower body 20.

Figure 2A:
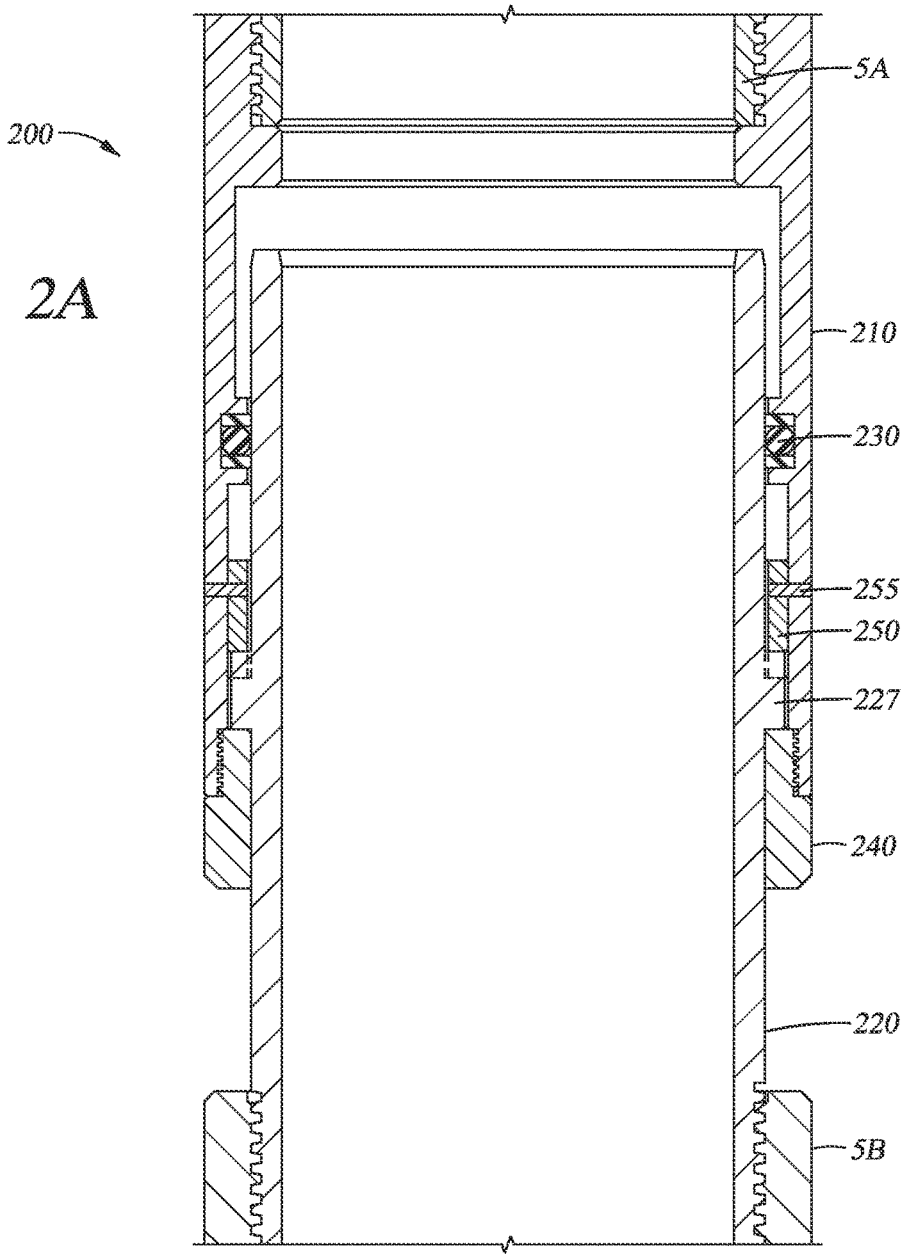
FIG. 2A is a cross-sectional view of another swivel in a first operating position according to one embodiment.

FIG. 2A is a cross-sectional view of a swivel 200 in a first operating position. The swivel 200 operates in a similar manner as the swivel 100. The components of the swivel 200 which are similar to the components of the swivel 100 have the same reference numeral but with a "200-series" designation. A full description of all the components will not be repeated herein for brevity.

Figure 2B:
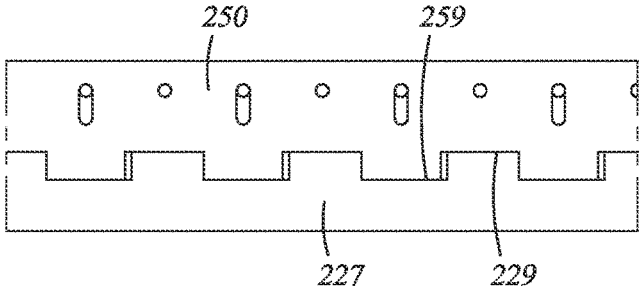
FIG. 2B is an enlarged view of an outer section of a ring member in contact with a shoulder of a lower body of the swivel in the first operating position according to one embodiment.

FIG. 2B illustrates a portion of the outer surfaces of the ring member 250 and the outer shoulder 227 of the lower body 220 in contact with each other. As shown in FIG. 2B, a difference of the swivel 200 is that the teeth members 259 of the ring member 250 and the teeth members 229 on the outer shoulder 227 of the lower body 220 have corresponding square shaped, castellated profile. Rotation of the upper body 210 is transmitted to the ring member 250 by the shearable members 255, which is transmitted to the lower body 220 by the teeth members 259 of the ring member 250 engaging the teeth members 229 on the outer shoulder 227 of the lower body 220. When the shearable members 255 are sheared by applying a compressive force to the upper body 210, the upper body 210 is rotationally decoupled from the lower body 220 so that the upper section 5A of the work string can be rotated relative to the lower section 5B of the work string.

Figure 3A:
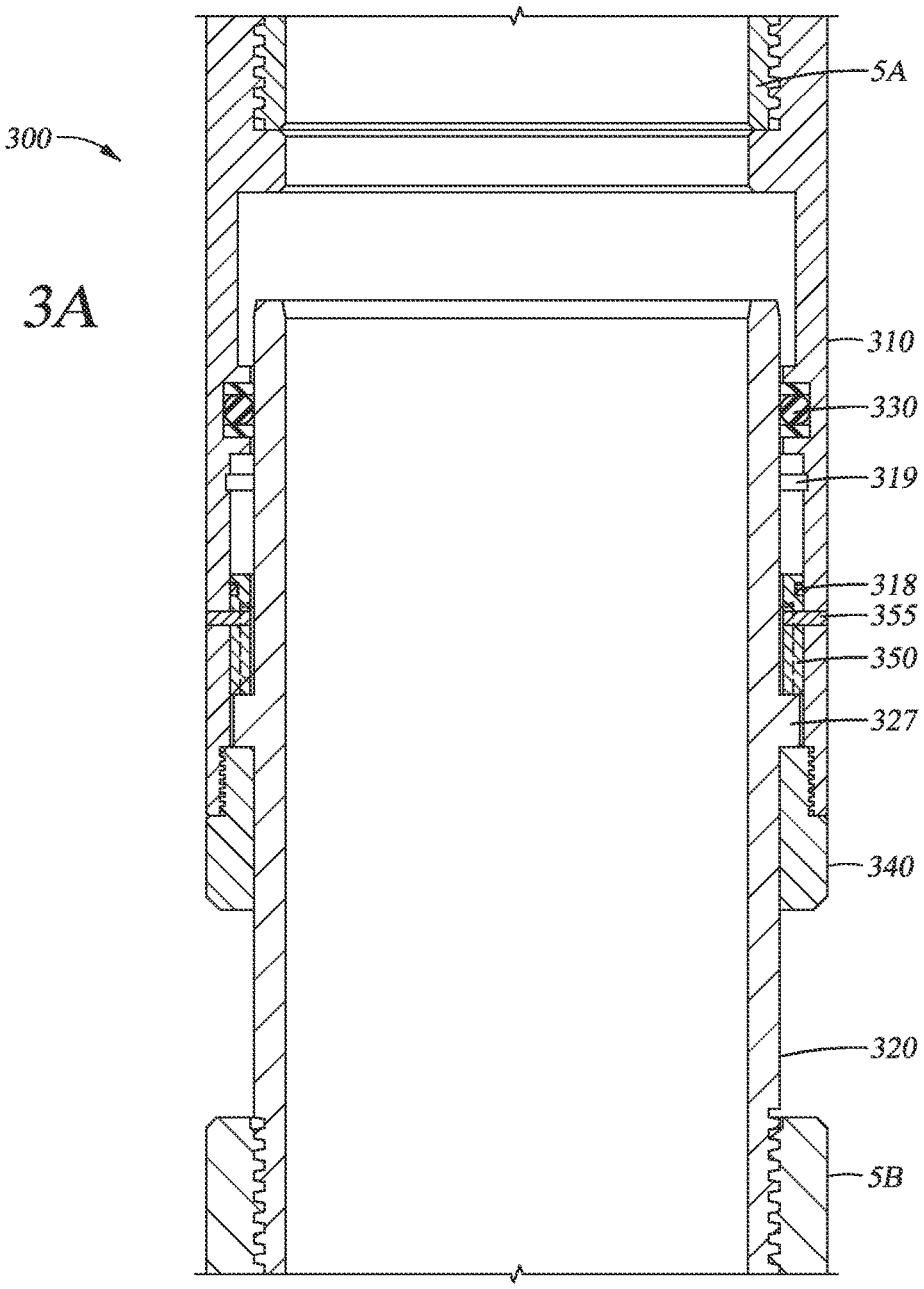
FIG. 3A is a cross-sectional view of another swivel in a first operating position according to one embodiment.

FIG. 3A is a cross-sectional view of a swivel 300 in a first operating position. The swivel 300 operates in a similar manner as the swivel 100. The components of the swivel 300 which are similar to the components of the swivel 100 have the same reference numeral but with a "300-series" designation. A full description of all the components will not be repeated herein for brevity.

Figure 3B:
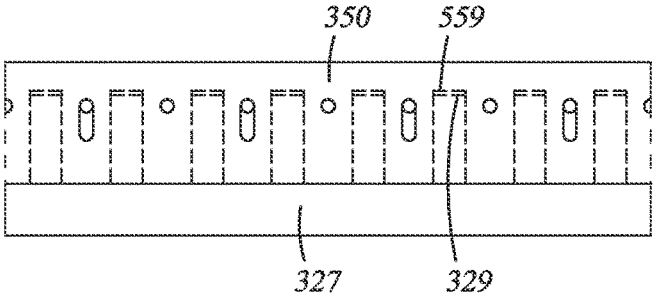
FIG. 3B is an enlarged view of an outer section of a ring member in contact with a shoulder of a lower body of the swivel in the first operating position according to one embodiment.

FIG. 3B illustrates a portion of the outer surfaces of the ring member 350 and the outer shoulder 327 of the lower body 320 in contact with each other. As illustrated in FIG. 3B, a difference of the swivel 300 is that the teeth members 329 of the lower body 320 include a plurality of splines and/or grooves that engage the teeth members 359 of the ring member 350 having corresponding splines and/or grooves. The splines and/or grooves can be formed on an outer surface of the lower body 320 above the outer shoulder 327. The corresponding splines and/or grooves can also be formed on an inner surface of the ring member 350 such that the shearable members 355 are positioned between the splines and/or grooves.

Rotation of the upper body 310 is transmitted to the ring member 350 by the shearable members 355, which is transmitted to the lower body 320 by the teeth members 329 of the lower body 320 engaging the teeth members 359 of the ring member 350. In one embodiment, the ring member 350 may only include splines that engage grooves formed on the lower body 320, or vice versa. When the shearable members 355 are sheared by applying a compressive force to the upper body 310, the upper body 310 is rotationally decoupled from the lower body 320 so that the upper section 5A of the work string can be rotated relative to the lower section 5B of the work string.

As illustrated in FIG. 3A, the swivel 300 optionally includes a snap ring 318 disposed in a groove formed in the outer surface of the ring member 350, which is configured to engage a groove 319 formed in the inner surface of the upper body 310. When the shearable members 355 are sheared, the upper body 310 may be lowered relative to the ring member 350 to a position where the groove 319 is located next to the snap ring 318. The snap ring 318 may partially extend into the groove 319 to stop further downward movement of the upper body 310.

Figure 4A:
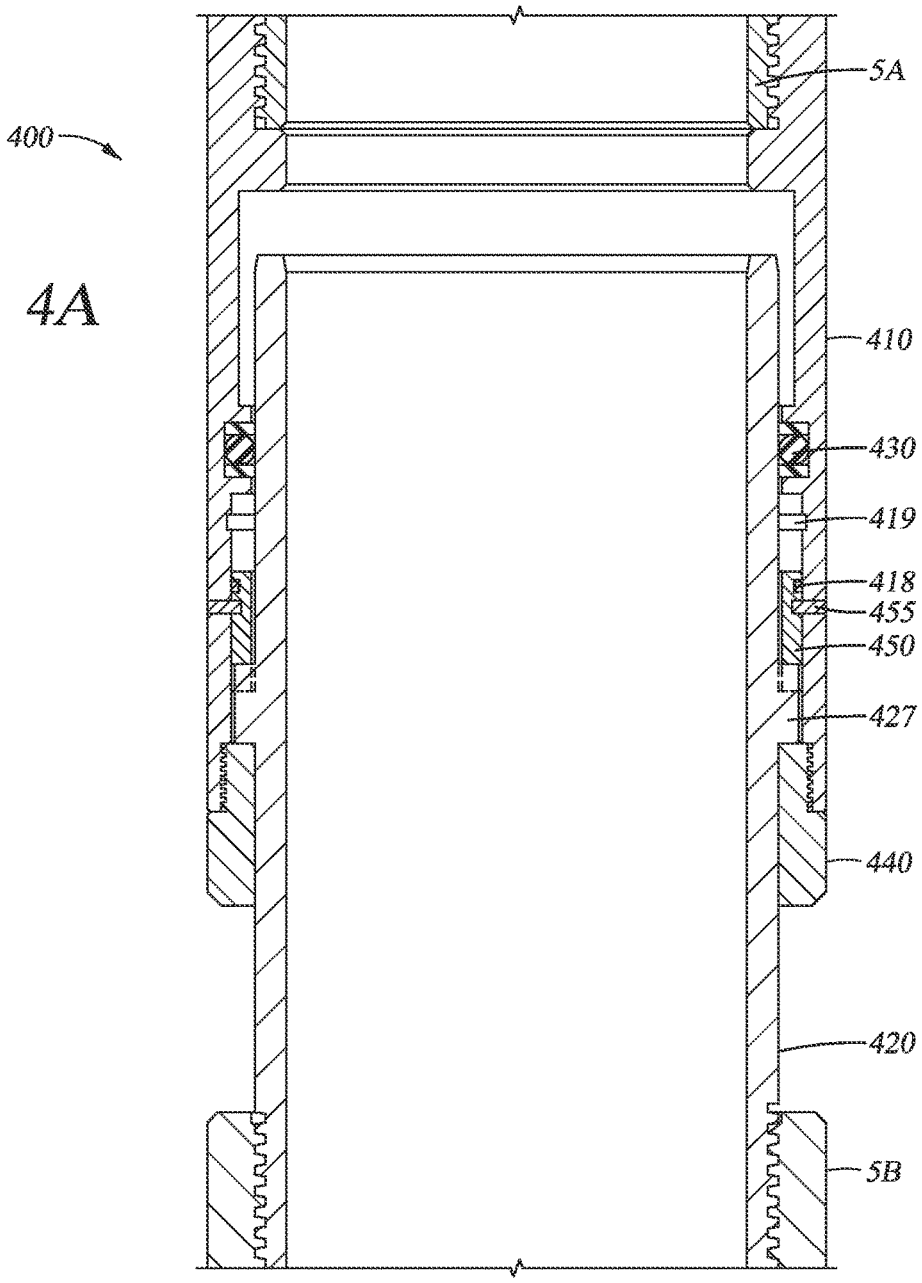
FIG. 4A is a cross-sectional view of another swivel in a first operating position according to one embodiment.

FIG. 4A is a cross-sectional view of a swivel 400 in a first operating position. The swivel 400 operates in a similar manner as the swivel 100. The components of the swivel 400 which are similar to the components of the swivel 100 have the same reference numeral but with a "400-series" designation. A full description of all the components will not be repeated herein for brevity.

Figure 4B:
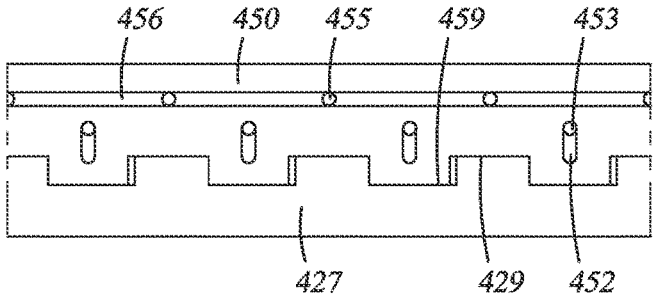
FIG. 4B is an enlarged view of an outer section of a ring member in contact with a shoulder of a lower body of the swivel in the first operating position according to one embodiment.

FIG. 4B illustrates a portion of the outer surfaces of the ring member 450 and the outer shoulder 427 of the lower body 420 in contact with each other. As shown in FIG. 4B, some differences of the swivel 400 are that the teeth members 459 of the ring member 450 and the teeth members 429 on the outer shoulder 427 of the lower body 420 have corresponding square shaped, castellated profiles. Rotation of the upper body 410 is transmitted to the ring member 450 by a plurality of pin members 453, which is transmitted to the lower body 420 by the teeth members 459 of the ring member 450 engaging the teeth members 429 on the outer shoulder 427 of the lower body 420. The pin members 453 extend into one or more longitudinal slots 452 formed in the ring member 450. The shearable members 455 extend into a groove 456 disposed about the outer circumference of the ring member 450 but do not transmit rotation from the upper body 410 to the ring member 450.

Figure 4C:
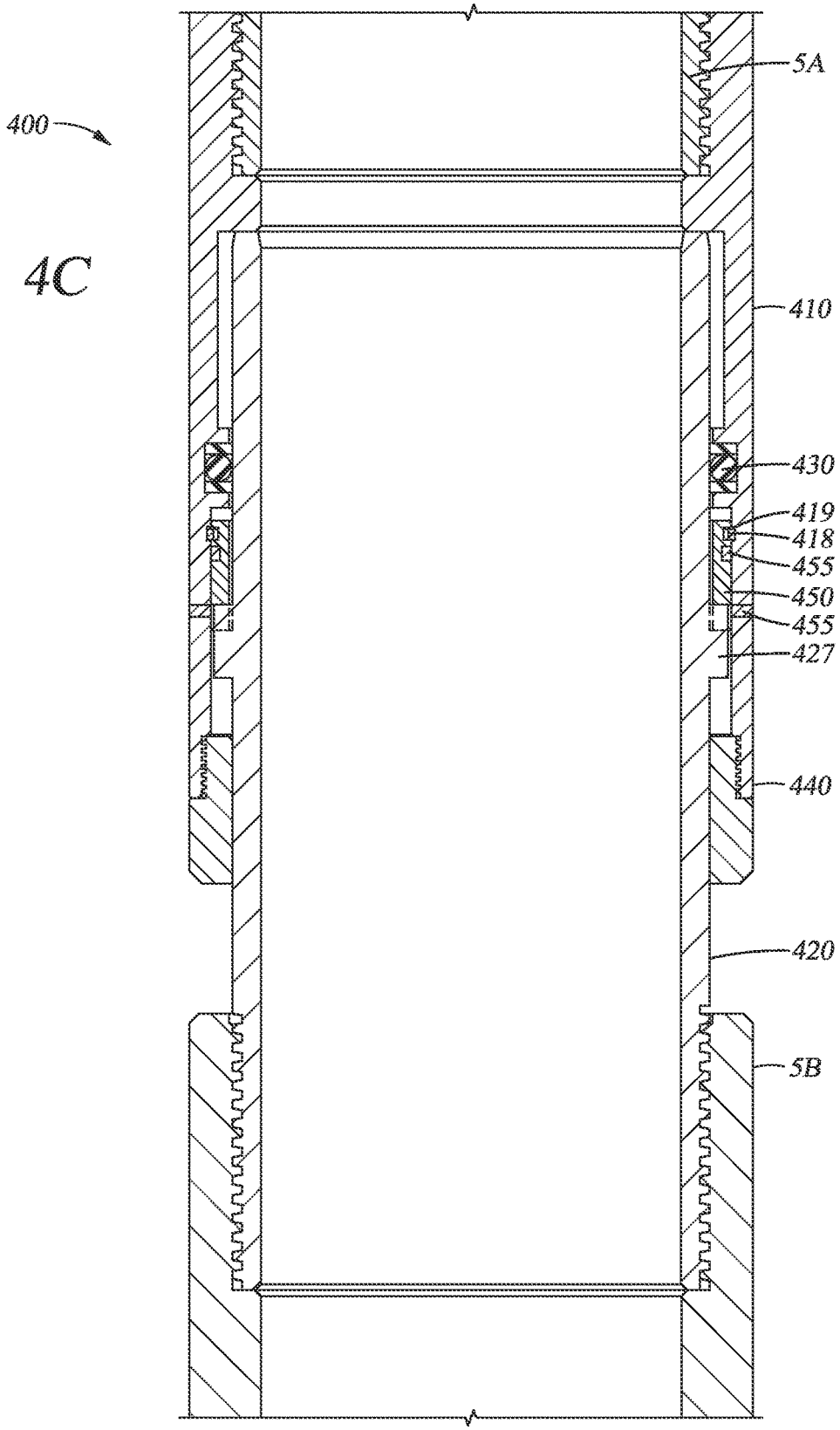
FIG. 4C is a cross-sectional view of the swivel in an intermediate position between the first operating position and the second operating position according to one embodiment.

As illustrated in FIG. 4C, a compressive force applied to the upper body 410 applies a shear force to the shearable members 455. When the shearable members 455 are sheared, the upper body 210 is moved downward relative to the ring member 450. The pin members 453 (illustrated in FIG. 4B) also move downward within the slots 452. The upper body 410 is lowered relative to the ring member 450 to a position where a groove 419 in the inner surface of the upper body 410 is located next to a snap ring 418 disposed in a groove formed in the outer surface of the ring member 450. The snap ring 418 engages and partially extends into the groove 419 to stop further downward movement of the upper body 410. The swivel 400 is in an intermediate position between the first operating position as shown in FIG. 4A and the second operating position as shown in FIG. 4D.

Figure 4D:
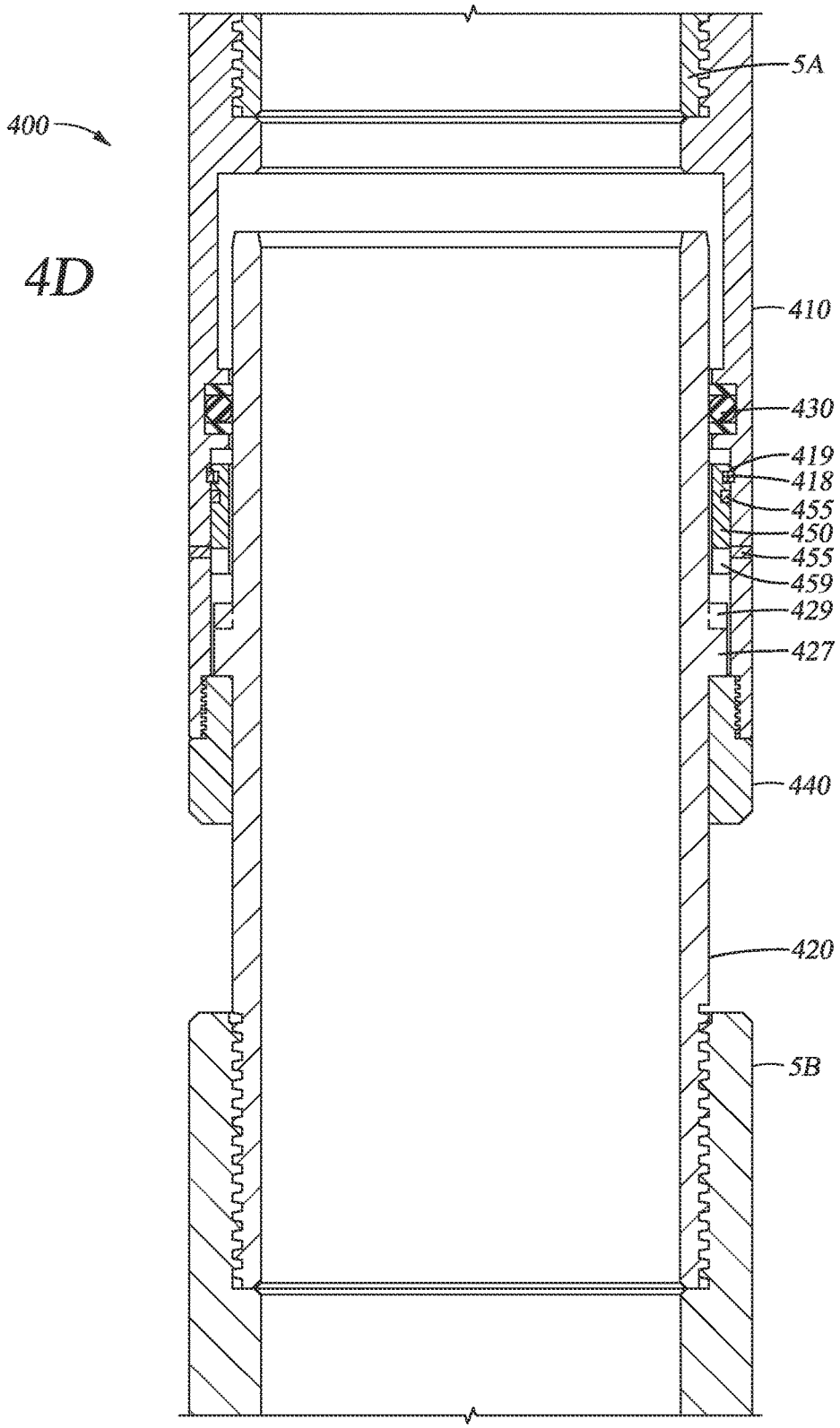
FIG. 4D is a cross-sectional view of the swivel in a second operating position according to one embodiment.

As illustrated in FIG. 4D, the upper body 410 is then raised or moved upward relative to the lower body 420. The ring member 450 is also lifted with the upper body 410 relative to the lower body 420 by the engagement of the snap ring 418 in the groove 419 of the upper body 410. The ring member 450 is raised to a position where the teeth members 459 disengage from or do not contact the teeth members 429 of the lower body 427 to rotationally decouple the upper body 410 from the lower body 420. Rotation of the upper body 410 and/or the ring member 450 is not transmitted to the lower body 420 when the teeth members 429, 459 are disengaged or are not in contact with each other. When the swivel 400 is in the second operating position illustrated in FIG. 4D, the upper body 410 is rotatable relative to the lower body 420 so that the upper section 5A of the work string can be rotated relative to the lower section 5B of the work string.

Figure 5A:
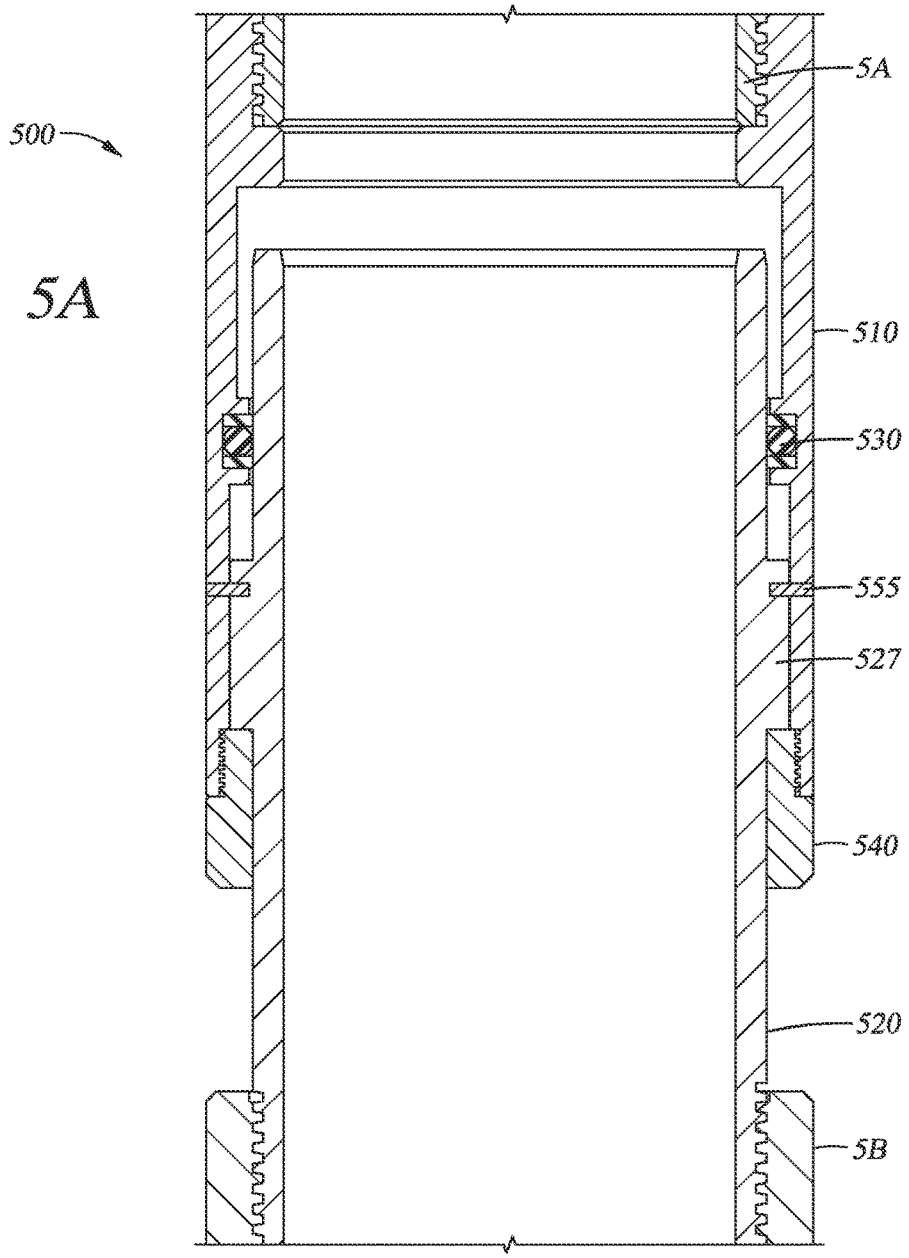
FIG. 5A is a cross-sectional view of another swivel in a first operating position according to one embodiment.

FIG. 5A is a cross-sectional view of a swivel 500 in a first operating position. The swivel 500 operates in a similar manner as the swivel 100. The components of the swivel 500 which are similar to the components of the swivel 100 have the same reference numeral but with a "500-series" designation. A full description of all the components will not be repeated herein for brevity.

Figure 5B:
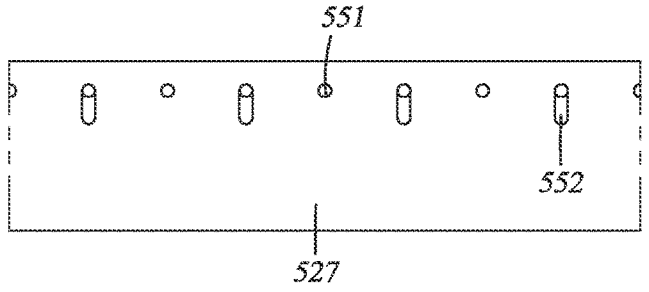
FIG. 5B is an enlarged view of an outer section of a lower body of the swivel in the first operating position according to one embodiment.

FIG. 5B illustrates a portion of the outer surface of the outer shoulder 527 of the lower body 20. As shown in FIG. 5B, a difference of the swivel 500 is that the shearable members 555 extend through the upper body 510 and into openings 551 and slots 552 formed on the outer surface of outer shoulder 527 of the lower body 520. Rotation of the upper body 510 is transmitted to the lower body 520 by the shearable members 555. However, when the shearable members 555 are sheared by applying a compressive force to the upper body 510, the upper body 510 is rotationally decoupled from the lower body 520 so that the upper section 5A of the work string can be rotated relative to the lower section 5B of the work string.

Figure 6A:
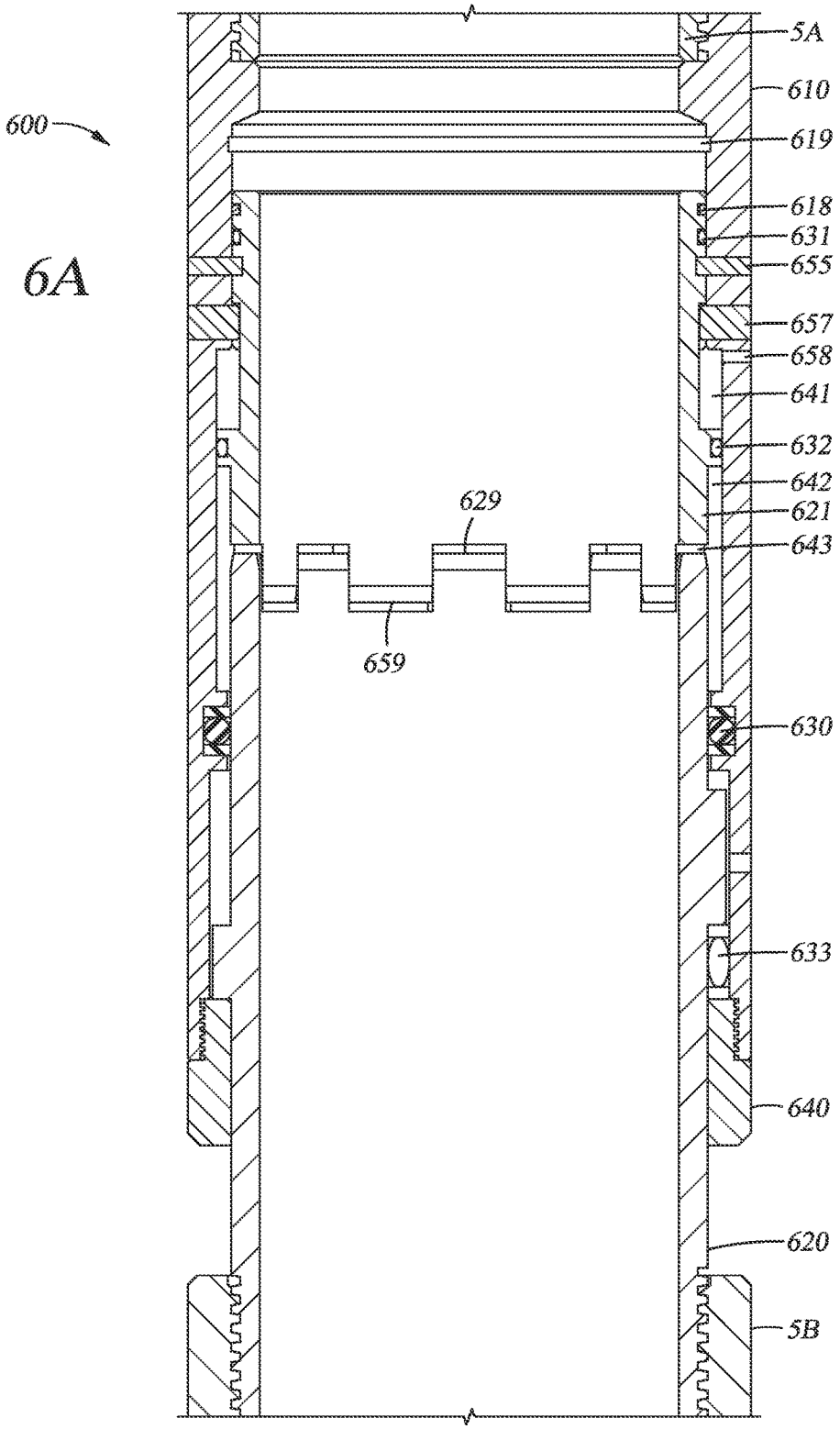
FIG. 6A is a cross-sectional view of another swivel in a first operating position according to one embodiment.

FIG. 6A is a cross-sectional view of a swivel 600 in a first operating position. In the first operating position, the swivel 600 is configured to transmit rotation of an upper section 5A of a work string to a lower section 5B of the work string. When actuated, the swivel 600 is configured to rotationally decouple the upper and lower sections 5A, 5B to allow the upper section 5A of the work string to rotate relative to the lower section 5B of the work string.

The swivel 600 includes an upper body 610 coupled to a lower body 620 by a ring member 621. One or more seals/bearings 630, 631, 632, 633 are disposed between the inner surface of the upper body 610 and the outer surfaces of the ring member 621 and/or the lower body 620 to form a sealed engagement and/or minimize friction between these surfaces. A load bearing member 640 is coupled to a lower end of the upper body 610 to support the weight of the lower body 620, the lower section 5B of the work string, and any other components connected below.

Rotation of the upper body 610 is transmitted to the ring member 621 by a plurality of shearable members 655 and/or a plurality of pin members 657 that are disposed through the upper body 610 and engage the ring member 621. The pin members 657 transmit rotation from the upper body 610 to the ring member 621 but extend into a longitudinal slot formed in the outer surface of the ring member 621 to allow longitudinal movement of the upper body 610 relative to the ring member 621. The rotation transmitted to the ring member 621 is transmitted to the lower body 620 by a plurality of teeth members 659 of the ring member 621 that engage a plurality of teeth members 629 of the lower body 620. The teeth members 629, 659 have corresponding square shaped, castellated profiles, although other profile shapes, such as saw tooth profiles, may be used.

When the swivel 600 is in the first operating position as shown in FIG. 6A, the upper section 5A of the work string, the swivel 600, and the lower section 5B of the work string rotate together as a single unit. The upper and lower sections 5A, 5B of the work string and any other tools coupled to the upper and lower sections 5A, 5B, including the swivel 600, can be rotated to form a wellbore and/or while being lowered into an existing wellbore. When desired, the swivel 600 can be actuated to rotationally decouple the upper section 5A of the work string from the lower section 5B of the work string as shown in FIG. 6B.

Figure 6B:
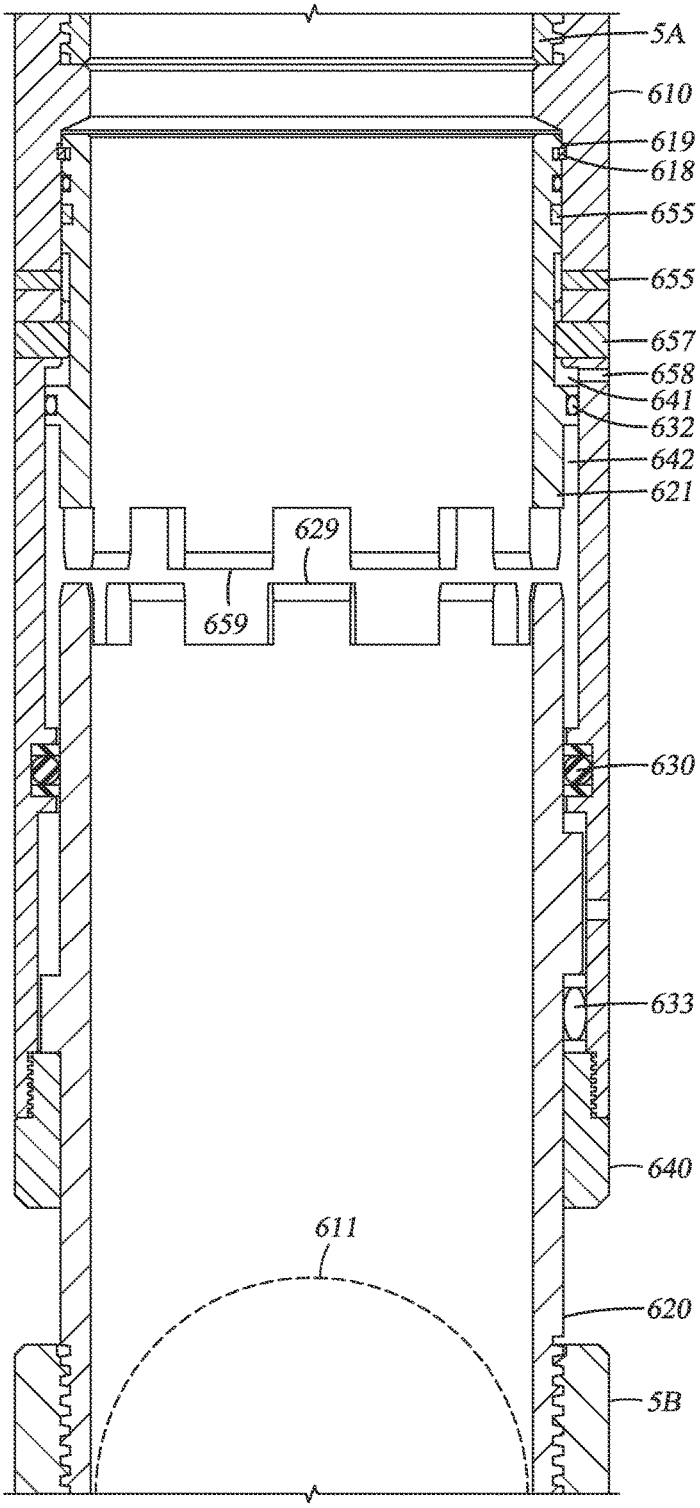
FIG. 6B is a cross-sectional view of the swivel in a second operating position according to one embodiment.

FIG. 6B is a cross-sectional view of the swivel 600 in a second operating position. To actuate the swivel 600 to the second operating position, a ball, dart, or other similar type of blocking member 611 can be dropped or pumped into the work string to a location within or below the swivel 600 to close fluid flow through the work string and allow the swivel 600 to be pressurized. Alternatively, the blocking member 611 may not be necessary if fluid flow through the work string was previously closed during a prior wellbore operation, such as an initial or primary cementing operation, performed through the work string. For example, a section of the work string below the swivel 600 may have been cemented in the wellbore during the initial or primary cementing operation in which a cement plug was dropped or pumped into the work string, which closed fluid flow through the work string, and which will allow the work string and thus the swivel 600 to be pressurized without having to drop or pump the blocking member 611 into the work string.

Pressure within the swivel 600 then can be increased to pressurize a chamber 642 via one or more openings 643 (illustrated in FIG. 6A) to a pressure greater than a pressure in a chamber 641 to apply a hydraulic, pressurized fluid upward force to the ring member 621 to shear the shearable members 655. The chambers 641, 642 are formed between the outer surface of the ring member 621 and the inner surface of the upper body 610. The chamber 641 is disposed above the chamber 642 and has a pressure equal to the surrounding annulus or wellbore pressure via one or more openings 658.

When the shearable members 655 are sheared, the pressurized fluid in the chamber 641 forces the ring member 621 to move upward relative to the upper body 610 and the lower body 620 until a snap ring 618 disposed on the outer surface of the ring member 621 engages a groove 619 formed on the inner surface of the upper body 610. The ring member 621 is also moved to a position where the teeth members 659 are disengaged from or do not contact the teeth members 629 on the lower body 610 to rotationally decouple the upper body 610 from the lower body 620. The snap ring 618 secures the ring member 621 to the upper body 610 and prevents the ring member 621 from moving back into a position where the teeth members 659 re-engage the teeth member 629.

When the teeth members 659 on the ring member 621 are disengaged from the teeth members 629 on the lower body 620, rotation of the upper body 610 cannot be transmitted to the lower body 620 by the ring member 621. Rather, the upper body 610 can be rotated relative to the lower body 620. The upper section 5A of the work string can be rotated relative to the lower section 5B of the work string when the swivel 600 is actuated to the second operating position.

In one embodiment, a compressive force can be applied to the upper body 610 to shear the shearable members 655 and move the upper body 610 to a position where the snap ring 618 engages the groove 619 to secure the ring member 621 to the upper body 610. The upper body 610 then can be raised to lift or move the ring member 621 to a position where the teeth members 659 are disengaged from or do not contact the teeth members 629 to rotationally decouple upper body 610 from the lower body 620. The work string can be set down on the bottom of the wellbore so that a compressive force can be applied to the upper body 610 to shear the shearable members 655. Additionally or alternatively, a sealing/anchoring member may be used to secure the lower section 5B of the work string in the wellbore so that a compressive force can be applied to the upper body 610 to shear the shearable members 655.

Figure 7C:
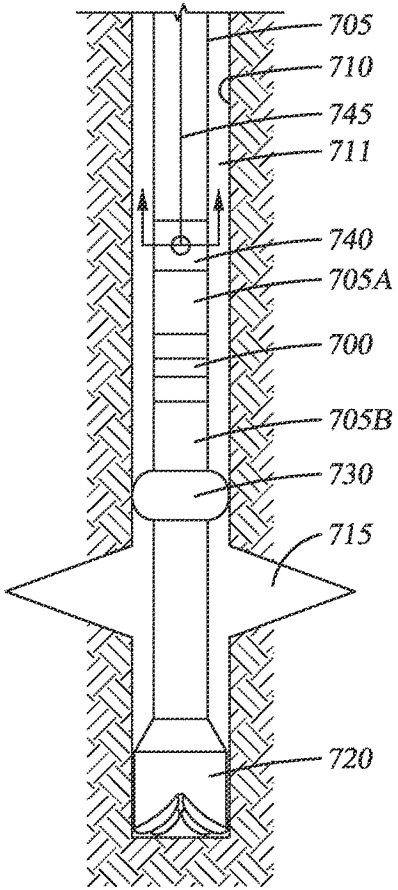
FIGS. 7A, 7B, and 7C illustrate a method of using a work string having a swivel according to one embodiment.
Figure 7B:
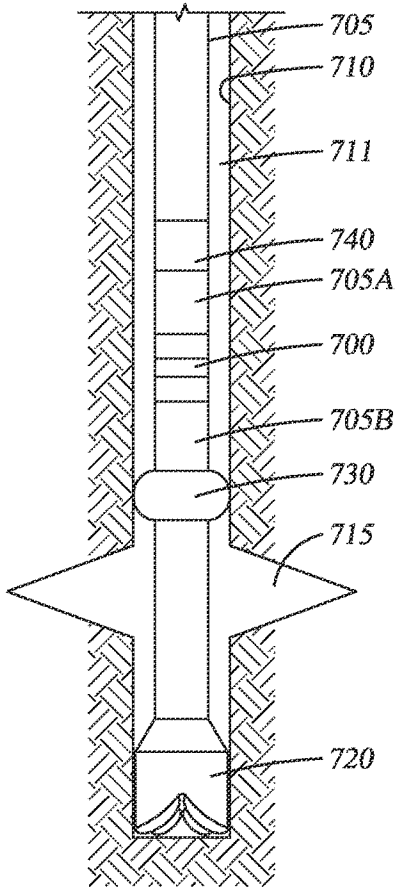
Figure 7A:
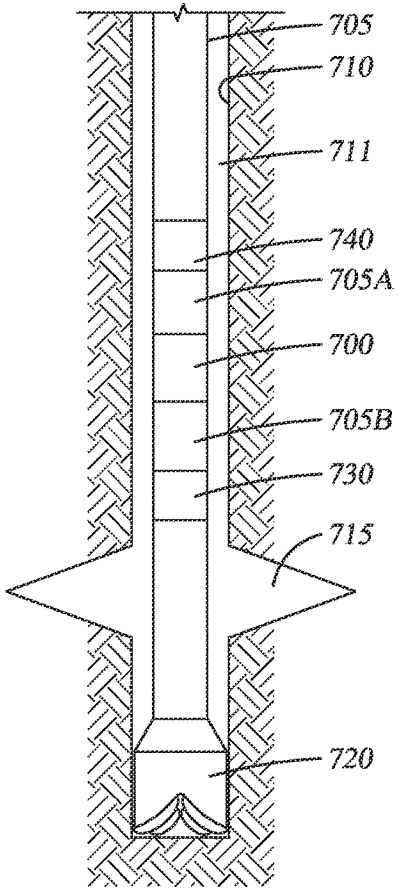

FIGS. 7A, 7B, and 7C illustrate a method of using a work string 705 having a swivel 700 within a wellbore 710 according to one embodiment. The swivel 700 can be any of the swivels 100, 200, 300, 400, 500, and 600 described herein. The swivel 700 is configured to rotationally decouple an upper section 705A of the work string 705 from a lower section 705B of the work string 705. The work string 705, including the upper and/or lower sections 705A, 705B, can include one or more tubular members, such as casing, liner, and/or drill pipe, which are coupled together and lowered into the wellbore 710 from the surface.

As illustrated in FIG. 7A, the work string 705 has a drill bit 720 connected at the lower end. The work string 705 includes the swivel 700, a packing element 730 disposed below the swivel 700, and a stage tool 740 disposed above the swivel 700. The work string 705 further includes one or more tubular members, such as casing or liner, coupled together that extend to the surface.

The entire work string 705 can be rotated to rotate the drill bit 720 to form the wellbore 710 through a reservoir 715, from which hydrocarbons can be recovered. The swivel 700 is in a first operating position so that the entire work string 705 rotates together as single unit. Rotation of the upper section 705A is transmitted to the lower section 705B via the swivel 700. In one embodiment, the drill bit 720 can be rotated independently and relative to the work string 705 using fluid circulated down through the work string 705.

Fluid can be supplied down into the wellbore 710 through an inner bore of the work string 705 and circulated back up to the surface through an annulus 711 formed between the outer surface of the work string 705 and the inner surface of the wellbore 710, carrying out the drilled earth and other wellbore debris. When the reservoir 715 is reached, the work string 705 can be cemented in the wellbore 710. A ball, dart, or other similar type of blocking member can be dropped or pumped into the work string 705 to close fluid flow out through the end of the work string 705.

As illustrated in FIG. 7B, the packing element 730 is actuated (such as by hydraulic, electric, and/or mechanical force) into engagement with the wellbore 710. The packing element 730 sealingly isolates the annulus 711 from the reservoir 715. The packing element 730 prevents or inhibits rotation and/or longitudinal movement of the lower section 705B of the work string 705 when the packing element 730 is in engagement with the wellbore 710.

Also illustrated in FIG. 7B is the swivel 700 actuated into a second operating position to rotationally decouple the upper section 705A of the work string 705 from the lower section 705B of the work string 705. The swivel 700 can be actuated using a mechanical force, such as by setting down the weight of the upper section 705A of the work string 705 to apply a compressive downward force to the swivel 700, and/or by raising or lifting the upper section 705A of the work string 705 to raise or lift an upper body portion of the swivel 700. The swivel 700 can be actuated using a hydraulic force, such as by supplying pressurized fluid through the work string 705 to pressurize the swivel 700.

As illustrated in FIG. 7C, the stage tool 740 is actuated (such as by hydraulic, electric, and/or mechanical force) to open a port of the stage tool 740 that provides fluid communication between the inner bore of the work string 705 and the annulus 711 of the wellbore 710. Cement 745 is circulated down through the inner bore of the work string 705, out into the wellbore 710 through the port of the stage tool 740, and back up to the surface through the annulus 711. The packing element 730 prevents the cement 745 from flowing down into the reservoir 715. In one embodiment, the stage tool 740, the swivel 700, and/or the packing element 730 can be actuated using Radio-Frequency Identification (RFID).

The swivel 700 enables the upper section 705A of the work string 705 to rotate relative to the lower section 705B of the work string 705. While the cement 745 is circulated to the surface through the annulus 711, the upper section 705A of the work string 705 can be rotated to provide a uniform distribution of the cement 745 within the annulus 711 and around the work string 705. The stage tool 740 can also be rotated with the upper section 705A of the work string 705 while circulating the cement 745. The cement 745 cements the work string 705 in the wellbore 710.

In one embodiment, the stage tool 740 can be positioned below the swivel 700 so that the stage tool 740 is not rotated while circulating the cement 745. In one embodiment, one or more fins may be coupled to the outer surface of the work string 705 to assist with distributing and circulating the cement 745 within the annulus 711 and back to the surface. After the cementing operation is complete, another work string can be used to drill through one or more components of the work string 705.

Figures 8A, 8B, 8C:
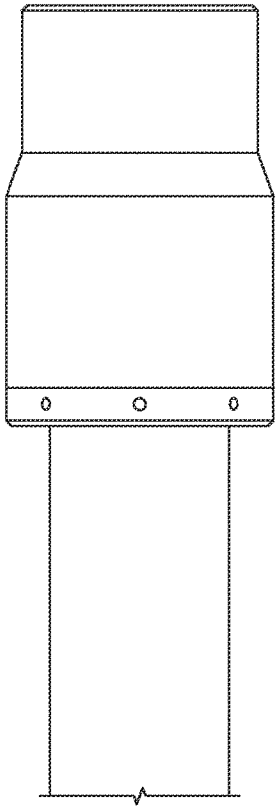
FIGS. 8A, 8B, and 8C illustrate a swivel and two examples of the dimensions/ratings of the swivel.

FIG. 8A illustrates a swivel, such as swivels 100, 200, 300, 400, 500, 600, and 700 described herein. FIG. 8B illustrates one non-limiting example of the dimensions and ratings of the swivel for use in a 9.625-inch casing. FIG. 8C illustrates one non-limiting example of the dimensions and ratings of the swivel for use in a 7-inch casing.

While the foregoing is directed to embodiments of the invention, other and further embodiments may be devised without departing from the basic scope thereof, and the scope thereof is determined by the claims that follow.

The invention claimed is:

1. A method of using a work string having a swivel within a wellbore, comprising:

rotating the work string within the wellbore, wherein rotation of an upper section of the work string is transmitted to a lower section of the work string by a ring member of the swivel, wherein the ring member is coupled to the upper section by a plurality of shearable members; and the ring member includes a plurality of teeth members on a bottom surface of the ring member that are engaged with a plurality of teeth members of the lower section;

actuating a packing element of the work string into engagement with the wellbore, wherein the packing element is disposed below the swivel;

actuating the swivel to rotationally decouple the upper section of the work string from the ring member and the lower section of the work string by shearing at least one of the plurality of shearable members; and circulating cement while rotating the upper section of the work string.

2. The method of claim 1, further comprising actuating the swivel using a mechanical compressive force.

3. The method of claim 1, further comprising actuating the swivel using a hydraulic force.

4. The method of claim 1, further comprising actuating a stage tool of the work string to open fluid communication between an inner bore of the work string and an annulus of the wellbore.

5. The method of claim 4, wherein circulating cement comprises circulating cement down through the work string, out of the stage tool, and back up to the surface through the annulus while rotating the upper section of the work string.

6. The method of claim 4, wherein the stage tool is located above the swivel.

7. The method of claim 1, wherein rotating the work string comprises rotating a drill bit to form the wellbore.

8. The method of claim 1, wherein rotation is transmitted from the upper section to the ring member via the plurality of shearable members, and from the ring member to the lower section via the plurality of teeth members on the bottom surface of the ring member.

* * * * *